US005184368A

United States Patent [19]

Holland

[11] Patent Number: 5,184,368

[45] Date of Patent: Feb. 9, 1993

[54] TOOTHBRUSHES

[75] Inventor: Neta Holland, Herzliya, Israel

[73] Assignee: Ohad Paz, Tel Aviv, Israel

[21] Appl. No.: 627,098

[22] Filed: Dec. 13, 1990

[30] Foreign Application Priority Data

Nov. 20, 1990 [IL] Israel ..... 96413

[51] Int. Cl.[5] ..... A46B 3/00

[52] U.S. Cl. ..... 15/167.1; 15/201; 15/171.1; 132/308

[58] Field of Search ..... 15/167.1, 201, 191 R; 132/308

[56] References Cited

U.S. PATENT DOCUMENTS

| | | | |
|---|---|---|---|
| 1,189,505 | 7/1916 | Stockton | 15/167.1 |
| 1,968,303 | 7/1934 | McMath | 15/167.1 |
| 2,882,544 | 4/1959 | Hadidian | 15/167.1 |
| 2,935,755 | 5/1960 | Leira et al. | 15/167.1 |
| 3,082,457 | 3/1963 | Lucibello et al. | 15/167.1 |
| 3,683,442 | 8/1972 | Holly | 15/167.1 |
| 4,240,452 | 12/1980 | Jean | 15/167.1 |
| 4,333,199 | 6/1982 | Del Rosario | 15/167.1 |
| 4,633,542 | 1/1987 | Taravel | 15/167.1 |
| 4,694,844 | 9/1987 | Berl et al. | 15/167.1 |
| 4,731,896 | 3/1988 | de la Tour | 15/167.1 |

FOREIGN PATENT DOCUMENTS

| | | | |
|---|---|---|---|
| 66259 | 12/1982 | Italy | 15/167.1 |

*Primary Examiner*—Harvey C. Hornsby
*Assistant Examiner*—Patrick F. Brinson
*Attorney, Agent, or Firm*—Benjamin J. Barish

[57] ABSTRACT

A toothbrush includes a plurality of bristle holders spring-urged outwardly from the brush head. In one described embodiment, the springs are produced by a planar strip of elastic material stamped with a plurality of spirally-extending slits pressed out of the plane of the strip to produce a plurality of helically-extending springs underlying each of the bristle holders. In a second described embodiment, the springs are in deformable bellows-shaped elements each underlying one of the bristle holders. In some described embodiments, the brush head is pivotally mounted to the handle.

10 Claims, 2 Drawing Sheets

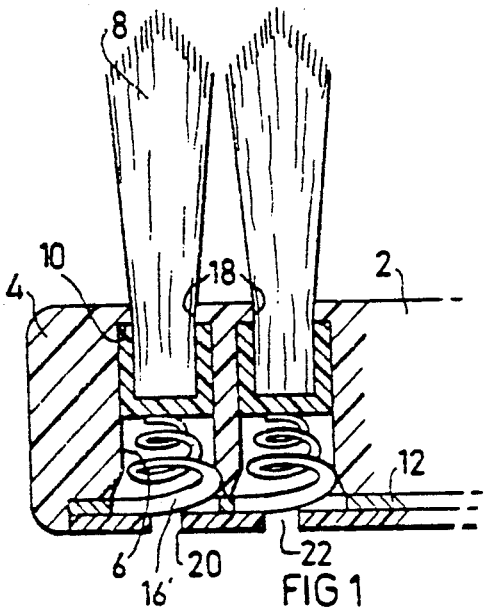
FIG 1
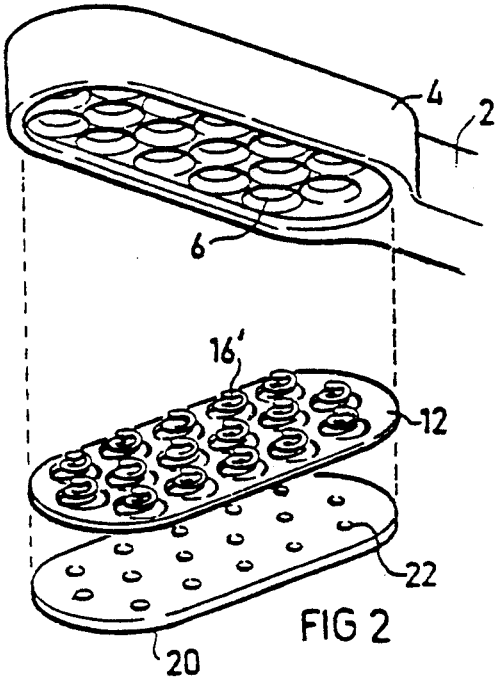
FIG 2
FIG 3
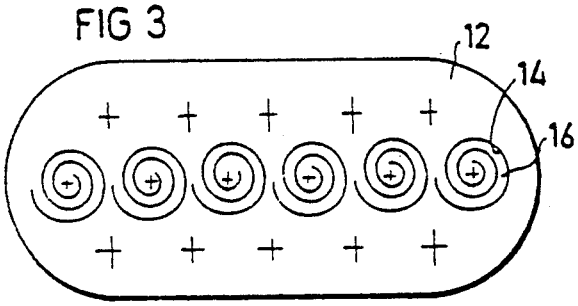
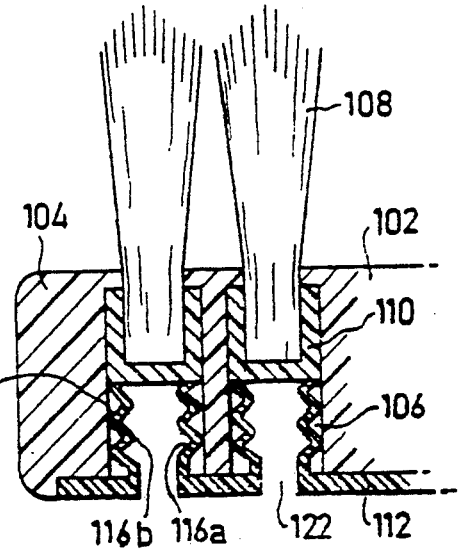
FIG 4
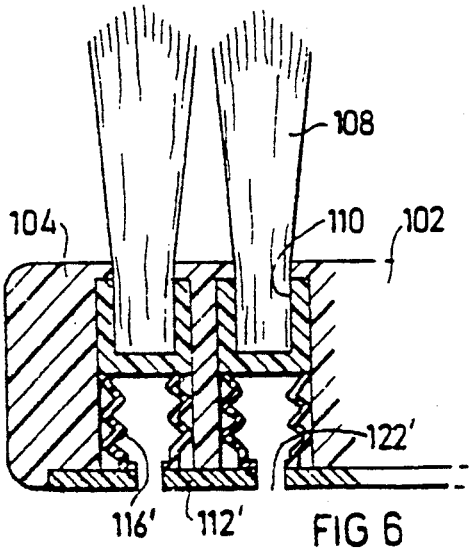
FIG 6
FIG 5
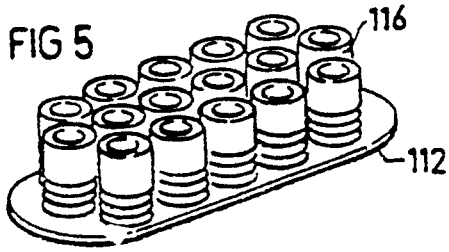

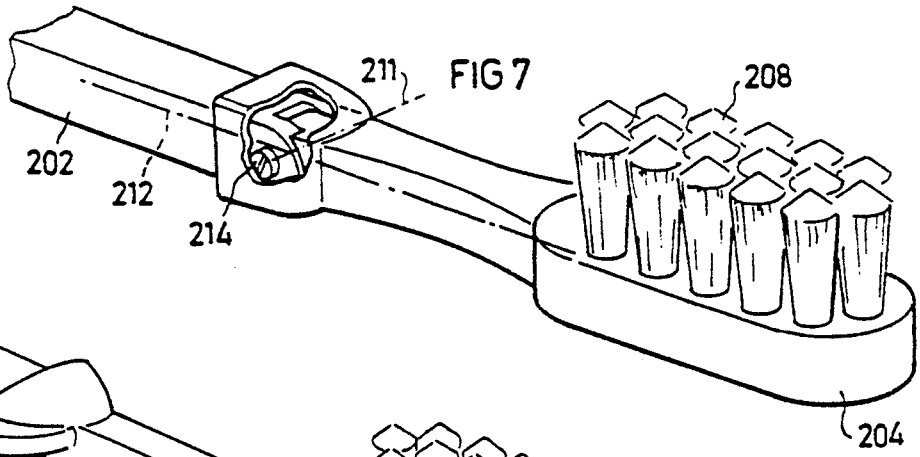
FIG 7
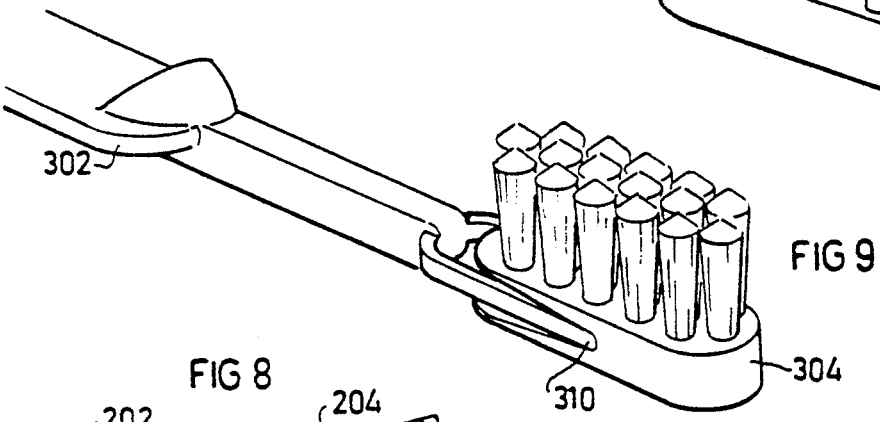
FIG 9
FIG 8
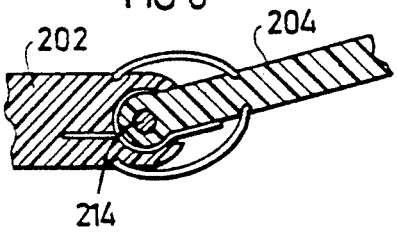
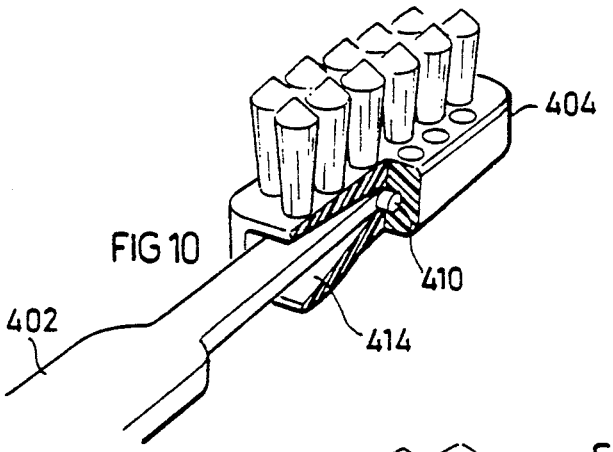
FIG 10
FIG 11
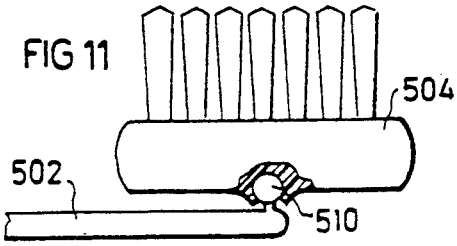
FIG 12
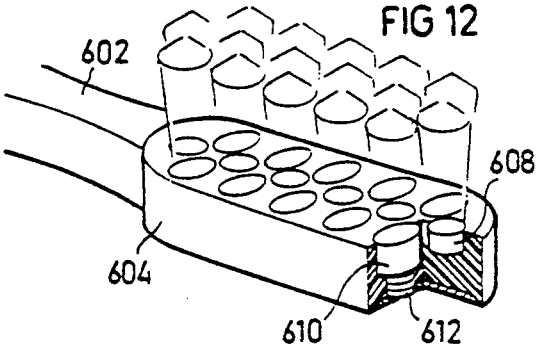

TOOTHBRUSHES

FIELD AND BACKGROUND OF THE INVENTION

The present invention relates to toothbrushes.

One known form of toothbrush includes spring-mounted bristle holders. The advantages of providing spring-mounted bristle holders in brushes generally, and toothbrushes specifically, have long been recognized, and a number of patents describe various brush constructions for this purpose. For example, brush constructions including various types of spring-mounted bristle holder are described in U.S. Pat. Nos. 2,882,544, 2,935,755, 3,082,457, 3,386,118, 3,683,442, 4,240,451, 4,240,452, 4,633,542 and 4,694,844. However, insofar as I am aware, none of these constructions has found widespread commercial use, presumably because of the limited bristle holder displacements permitted by the brush construction, the short useful life of the brush construction, and/or the relatively large expense required to produce the brush construction.

Another known form of toothbrush includes a brush head which is mounted at an obtuse angle with respect to the brush handle to permit better access to various surfaces of the teeth to be brushed. In the known constructions, however, the angle is fixed, and cannot be varied.

An object of the present invention is to provide a novel brush construction including spring-mounted bristle holders having advantages in one or more of the above respects.

Another object of the invention is to provide a novel brush construction permitting variation in the angle of the brush head with respect to the handle.

A further object of the invention is to provide a brush in which the brush head will always assume a position parallel to the surface being brushed, thereby increasing the brushing efficiency.

OBJECTS AND BRIEF SUMMARY OF THE INVENTION

According to one aspect of the present invention, there is provided a brush including a handle at one end and a brush head at the opposite end, the brush head including a plurality of bristle holders and spring means normally urging the bristle holders outwardly but permitting their inward movement during use of the brush head; characterized in that the spring means comprises: a planar strip of elastic material stamped with a plurality of spirally-extending slits at the bristle holders, to define a spirally-extending element integrally formed with the strip at each of the locations and in the same plane as the strip. Each of the spirally-extending elements is pressed out of the plane of the strip to produce a helically-extending spring element underlying each of the bristle holders and decreasing in diameter from the strip to the bristle holder.

According to a second described embodiment, there is provided a brush including a handle at one end and a brush head at the opposite end; the brush head including a plurality of bristle holders and spring means normally urging the bristle holders outwardly but permitting their inward movement during use of the brush head; characterized in that the spring means comprises a plurality of deformable bellows-shaped elements each underlying one of the bristle holders.

Brushes, and particularly toothbrushes, constructed in accordance with the foregoing features provide a number of advantages over the prior-known devices. Thus, they permit large displacements of the bristle holders, thereby increasing the efficiency of the brushing action; they provide a relatively long useful life; and they are inexpensive to produce in volume and at low cost.

In either of the above-described embodiments, the spring means may urge all the bristle holders outwardly; alternatively, the brush head may include at least two rows of bristle holders spring-urged outwardly and separated by a row of bristle holders fixed to the brush head.

According to another aspect of the present invention, there is provided a brush including a handle at one end and a brush head at the opposite end, coaxial with the handle, the brush head being pivotally mounted to the handle about an axis perpendicular to the axis of the handle and brush head.

In one described embodiment, the pivot axis of the pivotal mounting is located at the juncture between the brush head and the handle and includes a rotatable member for fixing the brush head at a predetermined angle with respect to the handle. Toothbrushes constructed in accordance with these features permit the brush head to be fixed at any desired obtuse angle with respect to the brush handle, for maximum brushing efficiency by the particular user.

According to another described embodiment, the pivot axis of the pivotal mounting passes through the brush head, the brush head being freely pivotal with respect to the handle so as always to assume a position parallel to the surface being brushed. Such a construction permits the brush head to automatically adjust itself to the contours of the teeth being brushed.

Further features and advantages of the invention will be apparent from the description below.

BRIEF DESCRIPTION OF THE DRAWINGS

The invention is herein described by way of example only, with reference to the accompanying drawings, wherein:

FIG. 1 is a fragmentary sectional view illustrating one form of toothbrush constructed in accordance with the present invention;

FIG. 2 is an exploded view more particularly illustrating the construction of the toothbrush of FIG. 1;

FIG. 3 is a top plan view illustrating the spring member included in the brush of FIGS. 1 and 2;

FIG. 4 is a fragmentary sectional view illustrating another type of toothbrush constructed in accordance with the present invention;

FIG. 5 is a perspective view illustrating the spring member in the toothbrush of FIG. 4;

FIG. 6 is a fragmentary sectional view, corresponding to that of FIG. 4, but illustrating a modification in the construction of the spring member;

FIG. 7 illustrates a toothbrush constructed in accordance with another aspect of the present invention;

FIG. 8 is a fragmentary view more particularly illustrating the pivotal mounting in the toothbrush of FIG. 7;

FIG. 9 illustrates a still further construction of toothbrush in acco 'ance with the present invention;

FIG. 10 illustrates a variation;

FIG. 11 illustrates a still further variation; and

FIG. 12 illustrates another variation.

DESCRIPTION OF PREFERRED EMBODIMENTS

The Embodiment of FIGS. 1-3

The toothbrush illustrated in FIGS. 1-3 comprises a handle 2 at one end, and a brush head 4 at the opposite end. The brush head 4 is formed with a plurality of sockets 6 each receiving a plurality of bristles 8 mounted within bristle holders 10 slidable within their respective sockets 6 so as to permit the bristle holders 10 to be individually moved either to an extended position, as illustrated in FIG. 1, or to a retracted position within their respective sockets.

The brush head illustrated in FIGS. 1-3 further includes a spring mounting cooperable with all the bristle holders 10 normally urging all the bristle holders outwardly to their extended positions in order to press the bristles 8 against the surface being brushed, but permit each bristle holder to be individually moved to its retracted position within its respective socket 6, according to the pressure applied by the respective bristles 8 to the surface being brushed. By thus spring-mounting the bristle holders 10 for individual movement, the bristles more effectively penetrate into all the crevices of the teeth and between the teeth, thereby producing an efficient brushing action. In addition, when the bristle holders are pressed inwardly during a brushing action, they stiffen the bristles, thereby further enhancing the brushing action.

In the embodiment of the invention illustrated in FIGS. 1-3, the spring mounting for the bristle holders 10 comprises a planar strip 12 of elastic material stamped with a plurality of spirally-extending slits 14 (FIG. 3) at spaced locations of the strip to underlie each of the bristle holders 10. The spiral-slits 14 thus define a plurality of spirally-extending elements 16 integrally formed with the strip 12 and in the same plane as the strip. After the strip is so formed, each of the spirally-extending elements 16 is pressed out of the plane of the strip 12, such that the spirally-extending elements 16 now becomes helically-extending spring elements, as shown at 16' in FIGS. 1 and 2, decreasing in diameter from the strip 12 to its outer end to engage its respective bristle holder 10, as more particularly shown in FIG. 1.

The brush head 4 is preferably made of suitable plastic material, as by injection molding, and is formed with a plurality of openings 18, one for each of the sockets 6 and communicating with the upper end of its respective socket. The opposite side of the brush head 4 is closed by a cover plate 20 formed with a drain opening 22 for each socket 6.

Preferably, the strip 12 is made of hard springy material, such as stainless steel, although it is contemplated that hard plastic material, such as hard nylon, may also be used. The helically-extending spring elements 16' permit a very large displacement of the bristle holders 10 for any given thickness of brush head 4 since the spring elements may be deformed back into the plane of the elastic strip 12, thereby avoiding any "dead space" within their respective sockets 6. In addition, such a construction provides a relatively long useful life for the brush head; moreover, since the spring elements 16' are produced by merely stamping the strip 12 and pressing the elements outwardly, such a construction can be produced in volume and at low cost.

The Embodiment of FIGS. 4 and 5

FIGS. 4 and 5 illustrate another construction of brush in accordance with the present invention, which construction also includes a handle 102, a brush head 104 formed with a plurality of sockets 106, and a plurality of bristles 108 mounted in brush holders 110 for slidable movement within their respective sockets. In the embodiment of FIGS. 4 and 5, however, the spring member for resiliently urging the bristle holders 110 to their extended positions, includes a common planar strip 112 integrally formed with a plurality of bellows-shaped elements 116 each underlying one of the bristle holders 110. Each of the bellows-shaped elements 116 is formed with a plurality of annular weakened lines **116*a* at its outer surface alternating with a plurality of weakened lines 116*b* on its inner surface imparting an elasticity to the element which permits it to assume an extended position as illustrated in FIG. 4 or to be collapsed to a contracted position. Thus, the bellows-shaped elements 116 in the construction of FIGS. 4 and 5 also, like the helical-spring elements 16' in the FIGS. 1-3 construction, normally urge their respective bristle holders 110 outwardly to their extended positions, but permit the bristle holders to be individually retracted inwardly of their respective sockets 106** when subjected to pressure.

In the construction illustrated in FIGS. 4 and 5, the bellows-shaped elements 116 may be integrally formed with the common base member 112, as by injection molding of a hard plastic material, thereby permitting them to be produced in volume and at low cost. As shown in FIG. 4, the common planar strip 112 may be used for closing that side of the brush head 104, thereby obviating the need for another closure plate corresponding to plate 20 in the construction of FIGS. 1-3. The common planar strip is formed with the drain openings 122.

The Embodiment of FIG. 6

FIG. 6 illustrates a variation wherein the deformable bellows-shaped elements, therein designated 16', are individually produced, as by injection molding, and are bonded to the common planar strip, therein designated 112'. As in the construction of FIGS. 4 and 5, the common planar strip 112' in the FIG. 6 construction may also be used as the cover plate for closing that side of the brush head 104 and formed with the drain openings 122'.

The Embodiment of FIGS. 7 and 8

The toothbrush illustrated in FIGS. 7 and 8 also includes a handle 202 and a brush head 204 coaxial with the handle. The brush head 204 may include spring-mounted bristles, as described above with respect to either of the constructions of FIGS. 1-3 or 4-6; alternatively, it may be a conventional brush head with fixed bristles 208.

In the toothbrush illustrated in FIGS. 7 and 8, however, the brush head 204 is pivotally mounted to the handle 202 about an axis, therein designated 211, perpendicular to the longitudinal axis 212 of the handle and brush head. The pivotal mounting in the embodiment of FIGS. 7 and 8 is located at the juncture between the brush head 204 and the hand 202. Thus, the brush head may be preset by the user to any obtuse angle with respect to the brush handle, and fixed in that position by tightening a pin 214.

The Embodiment of FIG. 9

FIG. 9 illustrates another toothbrush, also including a handle 302 and a brush head 304 connected to the handle by a pivotal mounting 310. In this case, however, the pivotal mounting 310 passes through the brush head 304, preferably through its transverse axis, rather than at the juncture between the brush head and the handle as illustrated in FIGS. 7 and 8. Moreover, the brush head 304 in the FIGS. 9 and 10 embodiment is freely pivotal with respect to the handle 302, so that the brush head always assumes a position parallel to the surface being brushed. The pivotal mounting thus permits the brush head to adjust itself to the contour of the brushed surface, thereby enhancing the brushing action.

The Embodiment of FIG. 10

FIG. 10 illustrates a toothbrush constructed similarly to that of FIG. 9, including a handle 402 and a brush head 404 pivotally mounted to the handle. In this case, however, the pivotal mounting is by a cylindrical member 410 carried at the end of a stem 414 formed as an extension of handle 402 and passing centrally through an opening in the brush head 404. The pivot axis defined by cylindrical member 410 is through the transverse axis of the brush head 404, as in the embodiment of FIG. 9, so that the brush head is freely pivotal with respect to the handle and may always assume a position parallel to the surface being brushed.

The Embodiment of FIG. 11

FIG. 11 illustrates a further toothbrush construction including a handle 502, a brush head 504, and a pivotal mounting 510 between the handle and the brush head. In the embodiment of FIG. 11, however, the pivotal mounting 510 is in the form of a ball-and-socket joint, producing a universal joint permitting the brush head 504 to be pivotted both parallel to and perpendicularly to the longitudinal axis of the handle and brush head. The ball-and-socket joint 510 is also preferably on the transverse axis of the brush head, as in the embodiment of FIGS. 9 and 10.

The Embodiment of FIG. 12

FIG. 12 illustrates a toothbrush, also including a handle 602 and a brush head 604, including three rows of bristle holders. In this case, however, each bristle holder 610 in the two outer rows is urged outwardly by a spring 612, whereas the bristle holders 608 in the middle row are fixed to the brush head 604. The spring 612 may be any of the types described above, e.g., the helical type as illustrated in FIGS. 1-3 or the bellows type as illustrated in FIGS. 4-6.

While the invention has been described with respect to several preferred embodiments, it will be appreciated that these are set forth merely for purposes of example, and that many other variations, modifications and applications of the invention may be made.

What is claimed is:

1. A brush including a handle at one end and a brush head at the opposite end, said brush head including a plurality of bristle holders and spring means normally urging at least some of the bristle holders outwardly but permitting their inward movement during use of the brush head; characterized in that said spring means comprises: a planar strip of elastic material formed with a plurality of spirally-extending slits at spaced locations of the planar strip underlying each of said bristle holders, to define a spirally-extending element integrally formed with said strip at each of said locations and in the same plane as said strip; each of said spirally-extending elements being pressed out of the plane of said strip to produce a helically extending spring element underlying each of said bristle holders and decreasing in diameter from said strip to the bristle holder.

2. The brush according to claim 1, wherein said spring means urges all the bristle holders outwardly.

3. The brush according to claim 1, wherein said brush head includes at least two rows of bristle holders spring-urged outwardly separated by a row of bristle holders fixed to the brush head.

4. The brush according to claim 1, wherein said brush head is formed with a plurality of sockets each receiving one of said bristle holders, which bristle holders are urged outwardly of their respective sockets by their underlying helically-extending spring elements.

5. The brush according to claim 1, wherein said strip of elastic material is of stainless steel.

6. The brush according to claim 1, wherein said brush head is pivotally mounted to said handle about a pivot axis perpendicular to the longitudinal axis of the brush and handle.

7. The brush according to claim 6, wherein said pivot axis is located between the brush head and the handle and includes a tightenable pin for fixing the brush head at a predetermined angle with respect to the handle.

8. The brush according to claim 6, wherein said pivot axis passes through the brush head, the brush head being freely pivotal with respect to the handle so as always to assume a position parallel to the surface being brushed.

9. The brush according to claim 6, wherein said pivot axis is at the transverse axis of the brush head.

10. The brush according to claim 4, wherein said pivotal mounting comprises a universal joint permitting the brush head to be pivotted both parallel to an perpendicularly to the longitudinal axis of the handle and brush head.

* * * * *